US005189560A

United States Patent [19]

Edwards et al.

[11] Patent Number: 5,189,560

[45] Date of Patent: Feb. 23, 1993

[54] SIGHTING TELESCOPE FOR SIMULTANEOUS VIEWING OF TARGET AND SIGHT

[75] Inventors: Bruce W. Edwards; D. Brandon Edwards, both of Virginia Beach, Va.

[73] Assignee: Edwards Optical Corporation, Virginia Beach, Va.

[21] Appl. No.: 657,093

[22] Filed: Feb. 15, 1991

[51] Int. Cl.[5] ..... G02B 23/00; F41G 1/00

[52] U.S. Cl. ..... 359/744; 359/428; 33/245

[58] Field of Search ..... 250/467.1; 33/233, 245, 33/246; 359/744, 424, 423, 422, 434, 428

[56] References Cited

U.S. PATENT DOCUMENTS

| | | | |
|---|---|---|---|
| 944,916 | 12/1909 | Shepard | 33/245 X |
| 1,060,469 | 4/1913 | Mach | 356/247 |
| 1,302,353 | 4/1919 | Friedrich | 250/467.1 |
| 2,207,124 | 7/1940 | Kollmorgen | 359/423 |
| 3,173,012 | 3/1965 | De Winter | 250/83.3 |
| 3,320,671 | 5/1967 | Richert et al. | 250/467.1 X |
| 3,340,614 | 9/1967 | Leatherwood | 33/245 |
| 3,861,803 | 1/1975 | Sallans | 33/245 X |
| 4,026,055 | 5/1977 | Weast | 33/245 X |
| 4,390,249 | 6/1983 | Rusinov et al. | 350/453 |
| 4,390,276 | 6/1983 | Budden et al. | 356/251 |
| 4,509,282 | 4/1985 | McMillon | 42/1 ST |
| 4,877,316 | 10/1989 | Edwasrds et al. | 350/537 |

FOREIGN PATENT DOCUMENTS

| | | | |
|---|---|---|---|
| 414152 | 5/1925 | Fed. Rep. of Germany | 33/245 |
| 1166663 | 10/1962 | Fed. Rep. of Germany . | |
| 307179 | 4/1933 | Italy | 33/245 |

*Primary Examiner*—Constantine Hannaher
*Assistant Examiner*—Edward J. Glick
*Attorney, Agent, or Firm*—Hamilton, Brook, Smith & Reynolds

[57] ABSTRACT

Telescopes, both Galilean and astronomical, are mounted to small arms such as rifles, shotguns, pistols and bows. These telescopes are miniature in size mounted into the aiming mechanism of the small arm. The telescope imagery is engineered to produce simultaneous viewing of target and sight. Objects, including a barrel end post, at varying distances from the scope are all observed clearly, sharply and simultaneously on the image or exit pupil of the scope. This imagery may be enhanced with the use of glare control structures. Galilean scopes are herein described as being used with a reticle structure on the scope eyepiece or on, or beyond, the objective lens for calibrating/aiming guns and bows. The reticle figures are most accurately employed at eye relief distances of from near point (approximately 25 cm) to arms length (approximately 56 cm).

26 Claims, 9 Drawing Sheets

SIGHTING TELESCOPE FOR SIMULTANEOUS VIEWING OF TARGET AND SIGHT

BACKGROUND OF THE INVENTION

Telescopes of various types and designs have been used for centuries to enhance the targeting capability of all types of fire arms and other projectile launchers. Astronomical scopes of large size and more recently Galilean scopes of large and miniature sizes have been employed to more accurately aim small arm guns and bows. There have been several undesirable features inherent in the use of these telescopes.

Such negative characteristics as cumbersome size and weight, complex calibration settings and calibration maintenance have long been tolerated in the larger sniper type scopes. These factors become even more difficult to contend with as the magnifying power of the scope increases. Field use of these large astronomical units subject them to conditions which negatively effect their delicate calibrating/aiming, alignment and accuracy.

Miniature telescopes, particularly of a Galilean nature, have been used to reduce size and weight problems for small arms, described in U.S. Pat. No. 4,877,316 to D. Brandon Edwards et al.

DISCLOSURE OF THE INVENTION

The present invention eliminates a fundamental shortcoming inherent in the non-magnified and magnified aiming or sighting mechanism of small arms and bows. The problem, which has been tolerated for centuries, is that of being able to clearly see only the barrel end post or the object being targeted, but not both at the same instance. This invention, comprised of a very low power miniature telescope integrated into the aiming system of a small arm, allows clear and distinct observing of both very near objects and quite distant objects simultaneously. This characteristic facilitates instantaneous target identification, gun calibration/aiming and rapid firing.

Further improvement in targeting accuracy using miniature magnifying telescopes of both Galilean and astronomical design is now possible by affixing a reticle figure on, or close to, either the eyepiece or objective lenses of these miniature scopes. Most distinct viewing of an eyepiece reticle occurs when eye relief is from the aimer's near point (approximately 25 cm) to arm's length (approximately 56 cm) for the normal adult eye. Most distinct viewing of an objective lens associated reticle can occur from positioning of the reticle between 10 cm and 56 cm beyond the objective lens.

In accordance with this invention, miniature telescopes are set into the sighting or aiming mechanisms of small arms and bows. These telescopes may be of both Galilean and astronomical design and are of relatively low power. The overall dimensions of these scopes vary from 0.6 cm to 2.5 cm in outer diameter and from 1 cm to 10 cm in length depending on the type of telescope. The exit pupil of these units varies from 0.1 cm to 0.6 cm. The fields of view of these magnifying scopes average from 4 to 10 degrees, and as a result, conform readily to the sighting principle or aiming scheme used with rifles, shot guns or hand gun peep-sights, iron sights and receiver sights.

A primary characteristic which sets this invention apart from those scopes currently being used or proposed for use on small arms involves the viewing of a greatly extended depth of field. Although extended depth of field miniature telescopes have been proposed in U.S. Pat. No. 4,877,316 for use for small arms, and their imagery has proven to be more advantageous than that of the larger sniper type scopes, a long existing problem inherent in calibrating/aiming small arms still remains. Miniature scopes previously used on small arms were generally of higher power, 3× to 6×, and consequently produced clearest or sharpest imagery on long barrel arms. Also, the inherent problem of not being able to see the barrel end post and the desired target at any single instant remained.

The present invention employs not only miniature telescope technology but also very low power, in the range of 1× to 3×, and variable eye relief to eliminate the previously described dilemma. Through the maintenance of low power and increased eye relief very near objects, such as gun barrel end posts, and distant targets can be viewed sharply and simultaneously as illustrated by the following formula (FIG. 10*b*):

$$ER = C - NOD$$

WHERE:

ER = Eye relief or the distance from the eye cornea to The exit pupil of the scope NOD = The distance between scope exit pupil and the end post of the small arm

AND:

C = A constant, for any given power, which is equal to the sum of the ER and the NOD The constant C is lower for low power scopes. Hence, as the eye relief for a low power scope, 1.25×, varies from 10 cm to 46 cm the nearest clearly visible object distance will vary from 46 cm to 10 cm respectively.

Consequently, moving a low power scope away from the eye in accordance with this invention enables the user to observe, simultaneously, clear images of objects such as target sights as near as 56 cm from the eye and objects as distant as 800 meters away.

The scopes to be further described in this invention, of both the Galilean and astronomical type, may also be reticlized using a new technique. By taking into account the eye's accommodation capability and knowing its distance of most distinct vision, or "near point" (which is generally taken as 25 cm in adults), a reticle figure on an astronomical or Galilean telescope can be placed and viewed on, or near, the rear surface of the eyepiece lens. Further, it will be shown that a reticle structure placed on or beyond the objective lens of the miniature scope can be made distinguishable on the exit pupil image plane of the scope.

Thus, in accordance with one aspect of the present invention, an aiming mechanism for sighting a target comprises a sight for locating the target within a field of view and a telescope. The sight may be a post at the end of a gun barrel. The telescope is positioned between the sight and the user's eye. The scope is of sufficiently low power and sufficiently low exit pupil diameter and is positioned for a sufficiently great eye relief that both a distant target and the sight are simultaneously within the user's field of view through the telescope. Preferably, the exit pupil diameter is less than 0.6 cm and the power is less than 3×. The eye relief should be at least 10 cm and is preferably not greater than 56 cm. The depth of field which is obtained may be sufficiently great that the sight, such as a barrel end post, may be positioned within about 66 cm from the eye.

In accordance with a further aspect of the invention, a reticle is positioned to be viewed within the field of view of the telescope. The reticle may be viewed simultaneously with a sight as the latter is viewed through the telescope. The reticle may be positioned beyond the objective lens. In that case, the reticle may be positioned nearer to the objective lens than even the large depth of field of the telescope. To compensate for blurring of the reticle, it should be a thin dark line. Alternatively, the reticle may be positioned at about the eye piece of the telescope by positioning the reticle and eye piece at about the eye's near point (typically about 25 cm). A nonmagnified reticle would then be viewed simultaneously with the magnified image through the telescope.

Although the present invention may be utilized with an astronomical telescope, it has particular utility with a simple Galilean telescope.

BRIEF DESCRIPTION OF THE DRAWINGS

The following drawings or figures serve to represent a preferred embodiment of this invention. The characters and numbers in the drawings refer to corresponding parts throughout the different views. These illustrations are not necessarily to scale, instead emphasis is being placed on the concepts, or principles, of the invention.

DESCRIPTION OF PREFERRED EMBODIMENTS

This invention relates to improvements realized when a miniaturized Galilean or astronomical telescope (hereafter also referred to as scope, optical instrument or system) is designed, or engineered, and adapted to uniquely facilitate or accommodate the calibrating/aiming of small arms. This invention was primarily designed to produce optical unity or magnified imagery possessing both great depth of focus and field either with or without an associated reticle.

Basic concepts underlying this invention have been known and utilized consistently in the field of photography. The application of these concepts with the principle of low power magnification in telescopic sights has, however, never been applied. Relatively high powered scopes with the widest possible fields of view have been considered to be necessary, and astronomical units alone met these requirements. Miniature telescopes of equal power necessarily do not afford wide fields of view initially. However, their uniquely fitted application to peep sight aiming mechanisms, and the associated advantages miniaturization offers, precludes the necessity for wide fields of view. It will be shown in the following discourse and drawings how useful the concept of very great depth of field viewing as displayed in photographic observation becomes when applied to low powered miniature telescopes mounted to aiming and sighting equipment.

Figure 1:
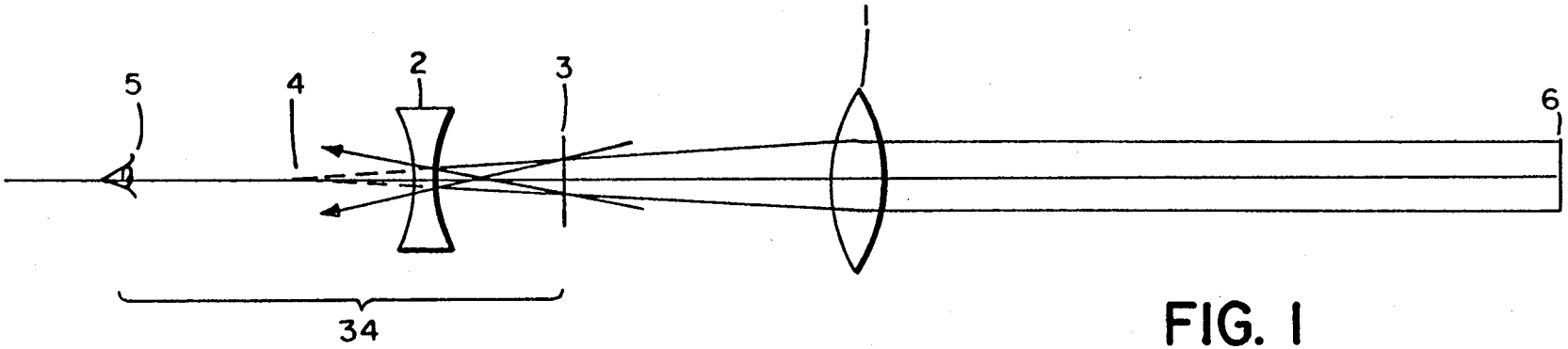
FIG. 1 is a diagram depicting the structural order of a Galilean telescope with the eye, lenses and distant object all being in line.
Figure 2:
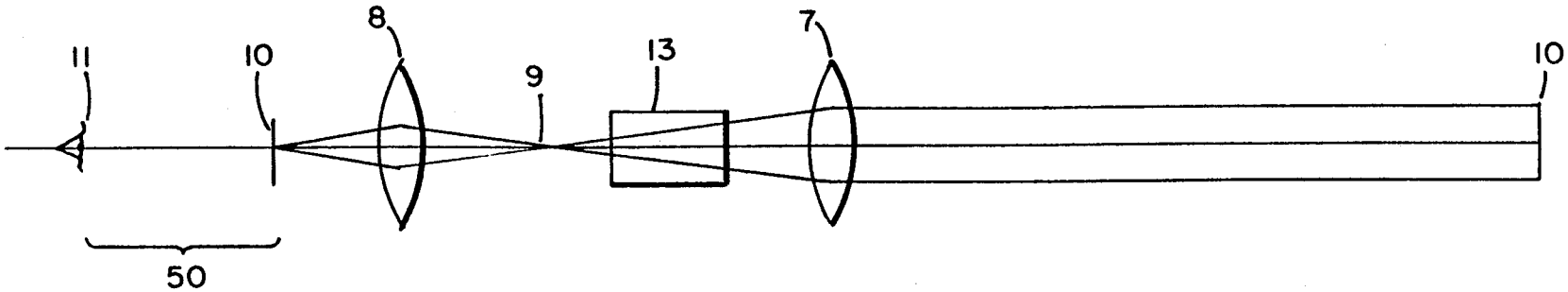
FIG. 2 illustrates the alignment and components of an astronomical type telescope including the eye and a distant object.
Figure 3:
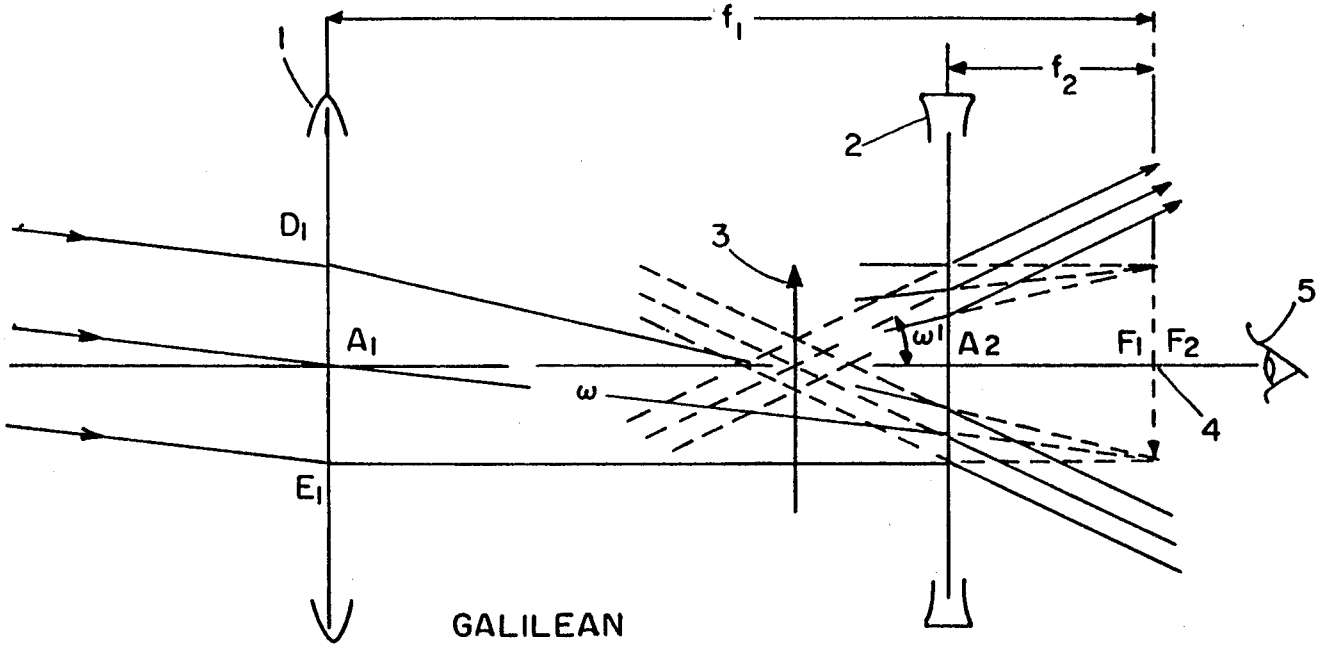
FIG. 3 represents a typical ray diagram of a miniature Galilean telescope; the rays illustrate the theoretical functioning of this unit.
Figure 4:
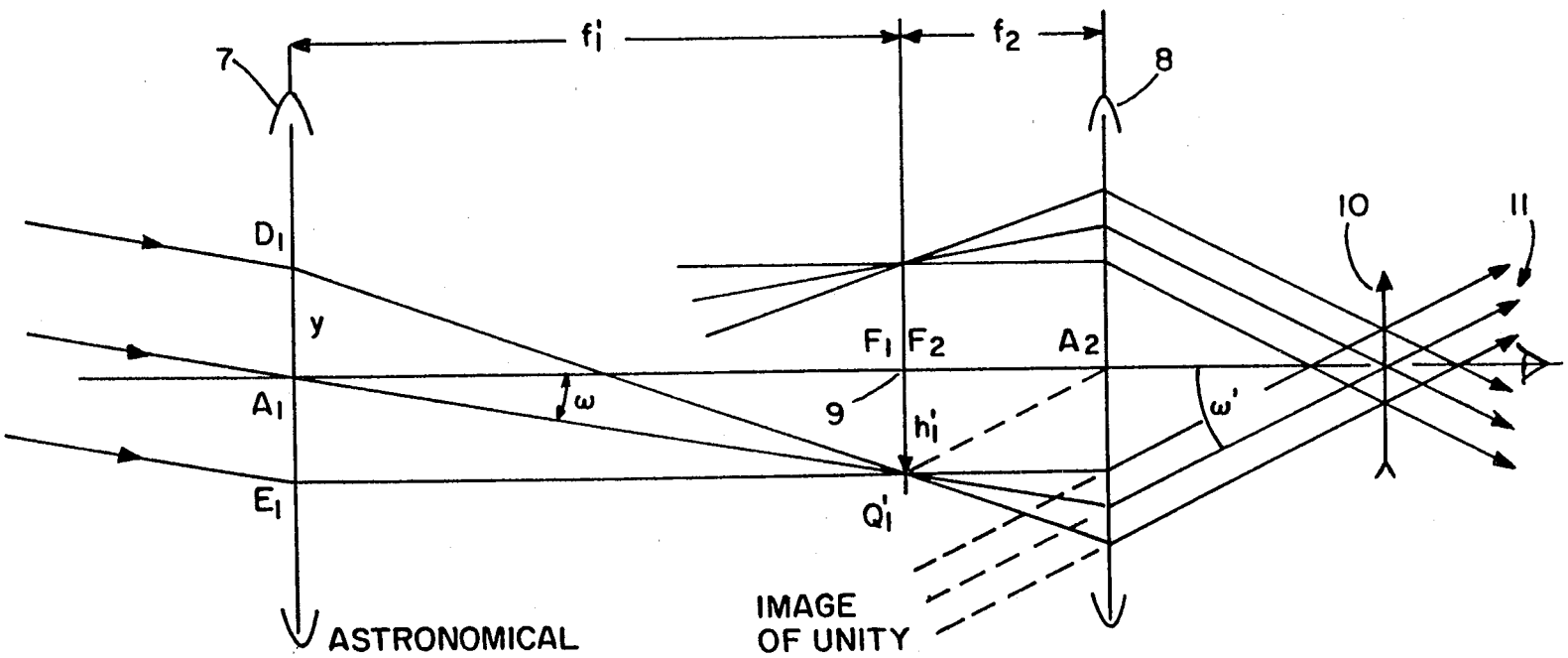
FIG. 4 is a diagram denoting the components, and their function, of a miniature astronomical telescope.

As is well known and can be seen from FIGS. 1 and 2, basic structures of two common telescope types, Galilean and astronomical, comprise an objective convergent lens 1, 7 and a divergent and convergent eyepiece lens 2, 8, respectively. The exit pupil or image plane for these two systems are 3, 10 accordingly. The common focal point for objective and eyepiece lenses are 4 and 9. The objects being viewed at distance in these two figures are at 6 and 12 respectively. It is also commonly known that the width of the image field at 3, 10 is controlled not only by the overall dimensions of diameter and length of the lenses and scope, but also by eye relief, the distance 34, 50 of the eye 5, 11 from the exit pupil image plane 3, 10. It should also be pointed out that eye relief as far as field of view is concerned is much more critical for Galilean scopes than for standard size astronomical systems in use today, especially for small arms. This characteristic hinges on the fact that the eyepiece 2 of the Galilean system is a divergent lens and its magnified image is virtual. FIGS. 3 and 4 better illustrate this factor through the use of ray tracings. FIG. 3 shows what happens when light image rays spread as they leave the scope system. Greater eye relief insures fewer image rays entering the eye pupil 5. Compensation for this is accomplished by decreasing the overall power of the scope system. Both FIGS. 3 and 4 are ray diagrams of FIGS. 1 and 2 respectively. For that reason numbers indicating the same elements and structures are used in a corresponding manner. It should be noted that the astronomical lens configuration in FIG. 2 produces an inverted exit pupil image for the system, as a result an erecting mechanism 13 must be inserted between the objective and eyepiece lenses. As is also well known, this procedure is not necessary for a Galilean system. This erecting mechanism for astronomical units consists of either a specially designed single element prism (Leman-Springer Prism) or a combination of two standard type triangular prisms 13. This erecting mechanism necessarily adds much to the scope's weight, diameter and length; characteristics which are not found in moderately powered Galilean systems. In the past the traditional design for scopes on small arms and targeting mechanisms has been towards high powers with improved wider image viewing fields. However, this invention is a major departure from the norm in the approach to calibration/aiming.

Figure 5:
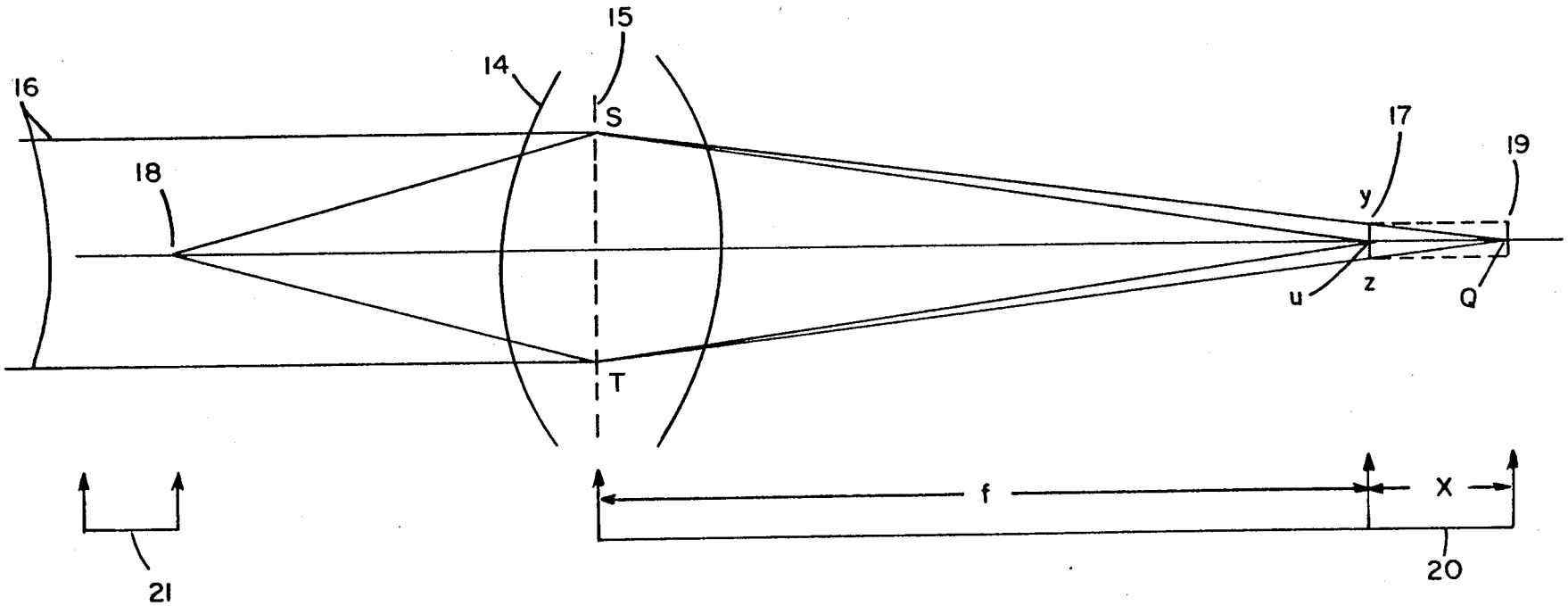
FIG. 5 is a ray diagram depicting the focus depth and the field depth of a convergent system.
Figure 6:
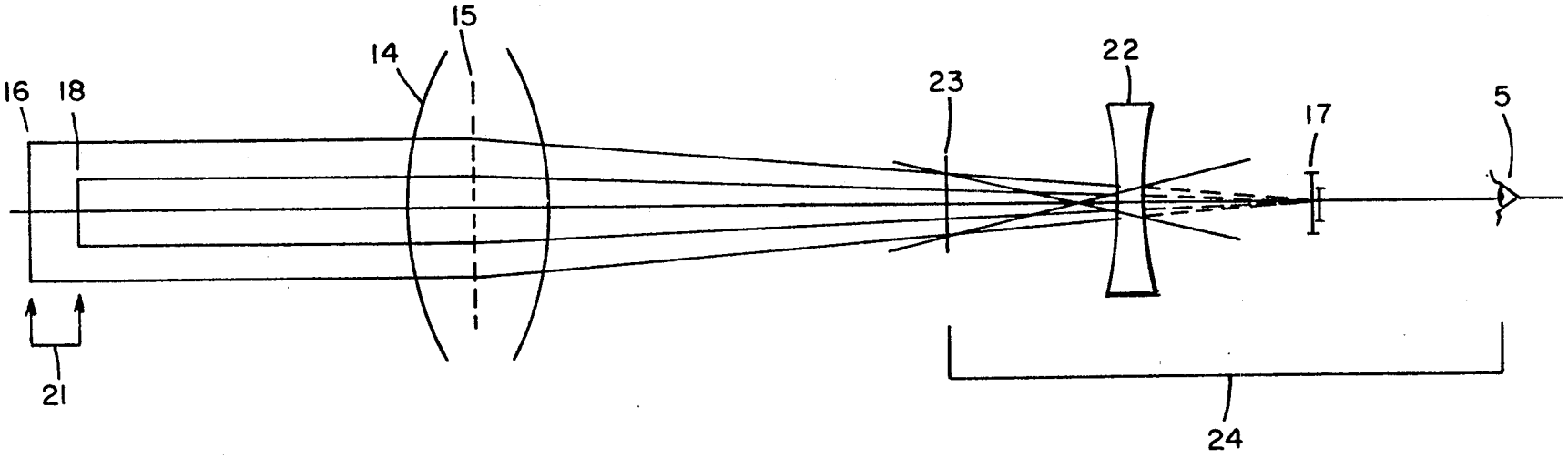
FIG. 6 combines the components and design of FIG. 5 with a divergent eyepiece lens, creating a Galilean miniature telescope design.

It should be emphasized that the telescope and the ordinary camera have several notable features in common. In particular the objective lens 1, 7 (FIGS. 1, 2) of the telescopes previously mentioned perform the same function as the objective or convergent lens system of a photographic camera (not shown). Both camera and scope objectives create a real, inverted image. For objects at a great distance to infinity these real image planes are formed at the primary focal point of each the camera and the scope objective element systems. In the case of the camera, the focused image falls on photographic film. For the telescope, the objective's image is processed by a second lens element, the eyepiece. This eyepiece may take the form of a divergent lens 2 or a convergent lens 8. In either case the eyepiece element acts as a hand magnifying lens would. In essence, the objective lens of the scope brings to focus an image of a distant object. This image is now in a much closer vicinity to the eye. At this point the eyepieces 2, 8 observe this image and magnify it providing enhanced detail. Here the telescope makes possible the direct observation of the objective's image with the added magnification, whereas the camera provides for indirect future observation at normal reading distance. In either case the role of the objective lens is critical for the proper formation of a real image with properties which allow the eye to eventually observe a great depth of field in the final image plane. FIGS. 5 and 6 will be used to explain this great depth of field concept.

FIG. 5 describes the objective element structure 14 of both an ordinary camera and the front half of a telescope. The primary reason why the eye is able to see an apparently great depth of field in a photograph hinges on the fact that, at the reading distance or eye relief at which a photograph is viewed, distant objects are seen clearly and sharply regardless of the distances at which the objects were located from the camera lens. The explanation for this phenomenon is complicated and lengthy. Hence, an abbreviated and somewhat simplified explanation will be presented.

A convergent lens system 14 such as that of a camera or telescope can be seen in FIG. 5. Number 15 is the exit pupil of this system without an eyepiece. Hence, a greatly distanced object at infinity is brought to focus along rays 16 on the principle focal plane of lens 14 at plane 17. Employing the same exit pupil, a closer object point 18 is brought into focus at point 19. However, on principle focal point plane 17 the image of 18 is blurry and has a blurry diameter of yz. This blurry nonfocused area is called a blur circle. For all such light emitting points on both very far (infinity) and near objects, triangles stu and yzq are congruent. And, the ratios st/f and yz/x are equivalent.

HENCE:

$$st/f = yz/x$$

WHERE:

st = the exit pupil diameter of lens 14 f = the focal length of lens 14 yz = the diameter of the blur circle

AND:

x = distance between principle focal plane and a near object focal plane

It should also be noted that x distance 20, for which the distance yz is sufficiently small that the object point is viewed clearly without perceived blur, is the depth of focus for 14 and that 21 for that depth of focus is the depth of field for lens 14. Realizing from the formula, st/f = yz/x, if st is made smaller in diameter, yz must also become smaller in diameter. Therefore, decreasing the diameter of the exit pupil 15 of lens system 14 also decreases the diameter of the blur circles. This factor is an extremely important one, particularly for miniature telescopes, the details of which will be described. Another point to be emphasized here is that miniature telescopes, by definition, must employ inordinately short focal length lenses in order to maintain small overall length and diameters. A short focal length objective lens, however, necessitates a shorter depth of focus range 20. Short depth means a sharper, decreased diameter blur circle for images slightly distanced from the principle focal plane 17 for lens 14.

At this juncture it is necessary to explain an important phenomenon. The eye has the ability to resolve objects on a two dimensional plane such as a photograph or telescope image. The minimum limit of this resolving power is for objects which span approximately one minute of arc or greater in size. Theoretically this limit is 47 seconds of arc but in practice one minute is more realistic. Hence, objects of less than one minute of subtended arc appear to the eye as points of source or reflected light. If the points of light emanating from an image viewed by the eye, whether it be a photographic plate or a real or virtual image plane, are accompanied by blur circles and the blur circles are small in diameter (less than one minute of arc) then the eye perceives the blur circle as an apparently sharp focused point. This occurs particularly for point light reflected from objects not falling in normal focus on the principle focal plane 17 (FIG. 5) of the objective lens, in this case 14. This explains why, given the proper eye relief, a photograph of a landscape appears to have objects and areas located at many different distances from the camera come to an apparently sharp and otherwise clear focus on the same two dimensional plane. By increasing eye relief, the blur circle associated with an object point becomes smaller.

It is also known, as a result of the previous description, that when a distant object is brought to focus on the principle focal plane 17 near objects will be seen with equal clarity from approximately half the distance to the focused object to infinity. The distance from lens system 14 to the object being focused at the principle focus of lens 14 is called the hyperfocal distance. Half of the hyperfocal distance to infinity will display objects or areas in apparently sharp focus on a photographic plate or real image plane 17 being viewed by the eye. In this instance the eye sees an image from an apparently great depth of field 21 on image plane 17.

When a real image with inherently great depth is viewed by either a divergent or convergent magnifying lens 22 a great depth of field characteristic is maintained with magnification at 23 (FIG. 6). The only requirement which must be met to maintain extensive depth of field is that blur circle size from an image point at 23, be kept small in diameter (basically less than one minute of arc). Several parameters may be adjusted relative to themselves or each other in order to ensure and or increase the field depth 21. These parameters include the exit pupil 15 diameter of lens system 14 (FIGS. 5, 6) the focal length of the same lens system 14 and the eye relief 24 employed to view the image plane 23.

An example of a great depth of field image plane will now be examined. Relative to the previously mentioned exit pupil 15 diameter, the pinhole camera could be considered having an extremely small diameter exit pupil. Long term exposure of the photographic plate, compensating for low luminosity, results in an extremely long depth of field photo print for a normal viewing distance from 25 cm to 46 cm. Hence the smaller the diameter of the objective lens exit pupil, the greater will be the image plane's depth of field. Again, the maintenance of a small diameter blur circle yz on 17 (FIG. 5), or halo of slightly out of focus light point, is critical to depth of field viewing.

As previously mentioned, FIG. 6 is designed to illustrate how a Galilean telescope in miniature low power form integrates the great depth properties of a convergent lens system 14 with a divergent magnifying lens element 22. Again, the negative eyepiece simply looks at the "intended" real image 17 brought to focus by the objective lens. The scope is adjusted (lenses moved together or apart) to bring to focus a virtual magnified image at 23. This is also the approximate location of the exit pupil of the eyepiece and hence the scope system.

In addition to the three previously mentioned parameters used to control the blur circle diameters or arc of slightly nonfocused light, there are two other important factors to be considered for the same purpose of blur circle size control. The divergent eyepiece lens has a scope image focusing capability which is readily utilized for the standard purpose of bringing the magnified image 23 to focus at an apparent great distance. As is known, infinity focusing produces the most comfortable viewing for the eye. It should also be noted that an infinity focused magnified image for a low powered scope adds insurance that the point light blur circles remain small in diameter. Further, regardless of the eye relief, that is, the distance between the eye 5 and the scope exit pupil plane 23 the scope can be readjusted for infinity focus.

A second important factor involves the power of these great depth of field minatures. When the powers of these miniatures are maintained at relatively low levels, the image of distance objects initially are of close-to-normal size. Referring to FIG. 6, this means that the final magnified image on the plane at 23 will display point light reflected from both far and near objects with initially small diameter blur circles. Essentially these blurs will be seen as relatively sharp points of light all on the same exit pupil plane 23. The greater the eye relief 24 the smaller the blur circle size appears to the eye. Maintenance of less than one minute of arc circles ensures great depth of field and hence clear viewing of both far and near objects on the same two dimensional scope exit pupil plane 23.

It should be pointed out at this time that even though the image plane or exit pupil 3 (FIG. 3) of the Galilean scope system appears to be emanating from the area of the focal point of the eyepiece between the objective lens and the eyepiece, the distance at which the images of the objects being viewed occur can be calculated by the formula:

Image Distance = Object Distance divided by $M^2$

WHERE:

M = The magnification of the scope

OR:

$$ID = \frac{OD}{M^2}$$

The exit pupil 10 (FIG. 4) of an astronomical scope is located in the vicinity of the eyepiece focal point between the eyepiece 8 and the eye 11.

It is emphasized that in these miniature scopes the exit pupil diameters are smaller in diameter than what would be considered standard for larger diameter scopes. The standard exit pupil for a large diameter unit would be approximately 0.6 cm to 0.8 cm or about the size of the eye pupil diameter. The miniature telescopes, however, have approximately one quarter to three quarters this diameter. The formula which dictates these diameters for a minature Galilean scope is as follows:

$$\text{Scope Exit Pupil Diameter} = \frac{\text{Objective Exit Pupil Diameter}}{\text{Power of Scope}}$$

OR:

$$SEPD = \frac{OEPD}{M} \text{ for a Galilean miniature}$$

AN EXAMPLE of such a telescope might be:

Power = 2.0×

Objective Lens Exit Pupil Diameter = 0.9 cm

THEREFORE:

$$SEPD = \frac{OEPD}{M}$$

AND:

$$SEPD = \frac{.9}{2}$$

$$SEPD = .45 \text{ cm}$$

Here a low powered 2× miniature Galilean telescope has an exit pupil of diameter 0.45 cm. The light is lower in luminosity than for standard scopes with larger exit pupils, however, this 0.45 cm diameter allows ample luminosity for viewing.

It is now possible to reticulize both Galilean and astronomical miniature telescopes using a new technical appproach. In this invention the reticle structure, which may take the shape of a crosshair or dot or any other such grid-like figure, may be attached directly to the scope itself or positioned immediately in front of the objective lens of the magnifying system. This method takes advantage of both the characteristics of low powered miniature telescopes for maintaining great depth of field as well as the eye's characteristics for accommodating the viewing of near objects placed at near point, approximately 25 cm.

Low powered miniature scopes, as previously detailed, can be designed to produce imagery which displays sharply clear object detail for those objects located at varying distances from the scope. This property is defined as great depth of field. It will be demonstrated in the progression of this text. A distinguishable reticle can be easily seen when placed approximately 10 cm beyond the objective lens of the miniature low powered scope. However, the required eye relief is rather long. Bringing the reticle closer to the objective lens while still observing a relatively clear view of it on the scope exit pupil plane is possible provided certain requirements are met. Taking into account the previous discussion concerning the importance of maintaining small diameter blur circles for point light not quite coming to focus on the principle plane of the objective lens, modifying the structural appearance of a reticle properly will allow for the imagery of the reticle to be satisfactorily viewed on the exit pupil image plane of the miniature scope.

Figure 7:
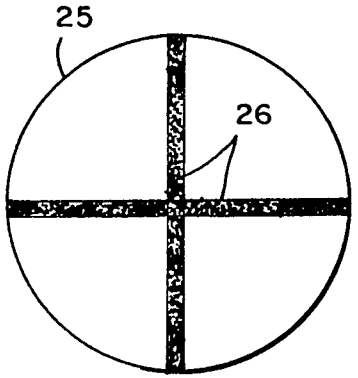
FIG. 7 is a representation of a coarsely defined reticle crosshair as viewed on an aiming, or sighting, miniature telescope.
Figure 8:
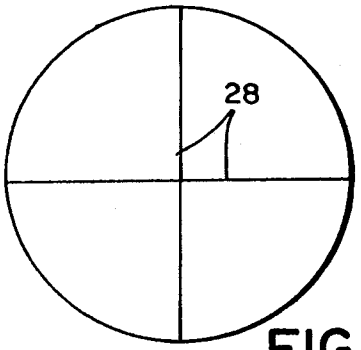
FIG. 8 is a representation of a thin lined reticle crosshair as viewed on an aiming, or sighting, miniature telescope.
Figure 9B:
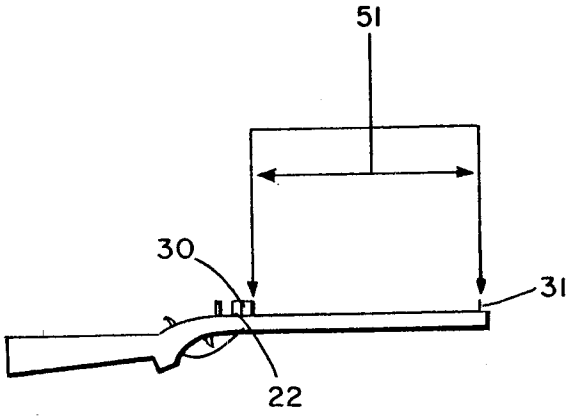
FIG. 9*b* illustrates the possible positionings of the reticle.

Here, blur circles created by point light reflected from a very near reticle figure, that is one almost touching or touching the objective lens, can have their diameters maintained at less than one minute of arc. This is accomplished by making the reticle very dark in color and "thin" in structure. The term thin refers to the "fine line" construction of the reticle figure itself. FIG. 7 illustrates a coarsely defined configuration as opposed to a "fine line" (FIG. 8) design for a crosshair reticle. The basic concept behind using a "fine line" reticle is relatively simple. The basic aim is to maintain apparent sharpness by reducing to a minimum any excessive blurriness. FIG. 7 with reticle view 25 displays greater numbers of blur circle points of reflected light from this coarsely defined reticle 26 than does the thinly produced reticle 28 (FIG. 8). If the fine line configuration of reticle 28 (FIG. 8) is controlled properly, depending on its location before the objective lens of the scope, its apparent clarity can be kept relatively sharp. Here again, the blur circles in the magnified image, as produced by the eyepiece lens, are maintained small in diameter and few in number. Generally speaking, the greater the eye relief the sharper a reticle of this nature will be seen.

Thus, when the reticle is positioned beyond the objective lens it can be viewed simultaneously with the target if it is positioned within the long depth of field of a small, low power scope with sufficient eye relief to the scope. Even if the reticle is positioned closer to the objective lens, so long as the reticle line is kept thin and dark, blurring due to positioning nearer than the NOD results in an acceptable reticle.

Figure 12:
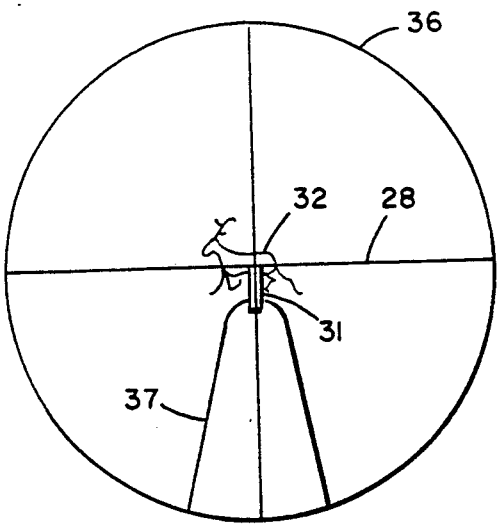
FIG. 12 is a replica of FIG. 11 with a reticle crosshair strategically added.

Rather than being positioned beyond the objective lens to be viewed through the telescope, the reticle may be positioned near to or on the eyepiece lens. When the reticle structure is located in close approximation to the eyepiece lens of the miniature scope, eye accommodation properties must be heavily considered. For example, when a reticle is placed close to or on the eye side of the eyepiece lens of the scope, the eye must be able to resolve the reticle structure itself in a normal manner without the telescope optics in order to see it clearly. In order to see through the eyepiece lens to detect a reticle printed on the opposite side surface of the eyepiece lens from the eye, the eye must resolve this reticle position in the same manner. Here, the word resolve refers to the eye's capability to bring to sharp focus on the retina images of both near and distant objects. In practice it is well known that a normal adult eye has the ability to clearly and sharply see near objects at approximately 25 cm. This distance is such a standard that it has been named the eye's "near point" or the nearest point of most distinct vision. Objects viewed within the 25 cm range are difficult, if not impossible, to bring to focus clearly on the retina. Although young persons such as some twelve year olds may be able to clearly focus objects closer, the standard average near point will be taken as 25 cm for present purposes. Hence, if a low powered miniature telescope with an eyepiece reticle were placed at near point or beyond, such as at arm's length, not only would a great depth of magnified field be seen in the scope but also the nonmagnified reticle would be clearly visible superimposed over the magnified field (FIG. 12). Reticles located within an astronomical telescope between lenses are quite common. However, a reticle placed in air between Galilean lenses is not usable primarily because the eyepiece lens is a divergent lens. In this divergent form, the eyepiece sees only real images 3 and not real objects; a primary characteristic of divergent lenses.

It has previously been noted that a primary purpose for this invention is to bring about significant improvements in the way small arms (such as hand guns, rifles, shotguns and bows) are calibrated/aimed. Further, it is also the intent to integrate this invention into the aiming mechanisms of these arms without altering the basic physical structure of the arm calibration/aiming mechanism. Here the visual medium through which the aimer is observing the target is modified from a magnification stand point and only slightly.

When these miniature low power telescopes 30 are attached to or built into peep sight, iron sight or receiver sight assemblies 29 (FIG. 9*a*) they provide the element of clear depth of field 21 necessary for the more accurate calibration/aiming of the weapon. Typical mounting of the scope is presented in U.S. Pat. No. 4,877,316.

Figure 9A:
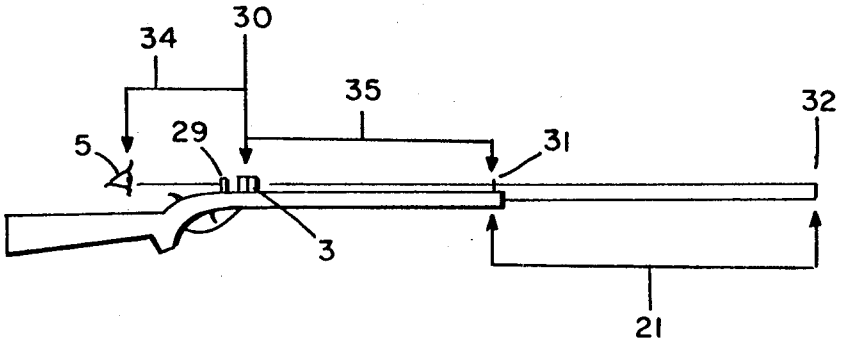
FIG. 9*a* diagrams a small fire arm with a miniature telescope attached; visual field depth and eye relief are emphasized.
Figure 10A:
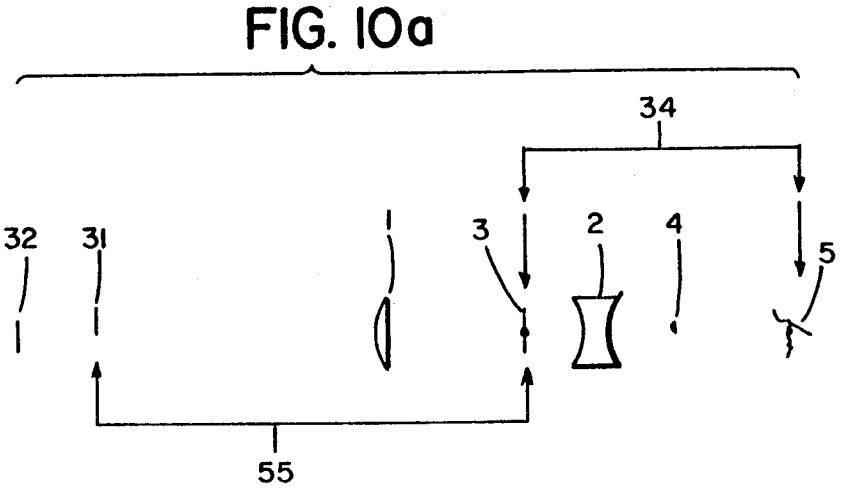
FIG. 10*a* is a diagram of a Galilean miniature scope with emphasis placed on visual field depth and associated eye relief.

The exit pupil image planes of the scopes involved in this invention were described as two dimensional magnified image planes which display a great depth of field on 23 (FIG. 6). This serves to eliminate a calibration-/aiming problem which has here-to-fore been tolerated. This problem involves a question of simultaneous clarity. Essentially, before this invention, either the end post 31 of a small arm or the target 32 (FIGS. 9*a*, 10*a*) was clearly focused on the eye retina at any one instant, but not both simultaneously. As can be understood from the prior discourse, this invention provides such great depths of field that simultaneous viewing of both end post (and reticle, if used) and target are possible. Such viewing is possible provided the scope power, eye relief and the proper miniature scope dimensions are properly matched and maintained. Also the distance 35 between the barrel end post 31 and the scope exit pupil plane 3 must be coordinated with eye relief 34 (FIGS. 9*a*, 10*a*).

The reticle 28 which may be formed on a transparent plate may be positioned within the space 51. The reticle may also be placed on the eyepiece 22.

Figure 10B:
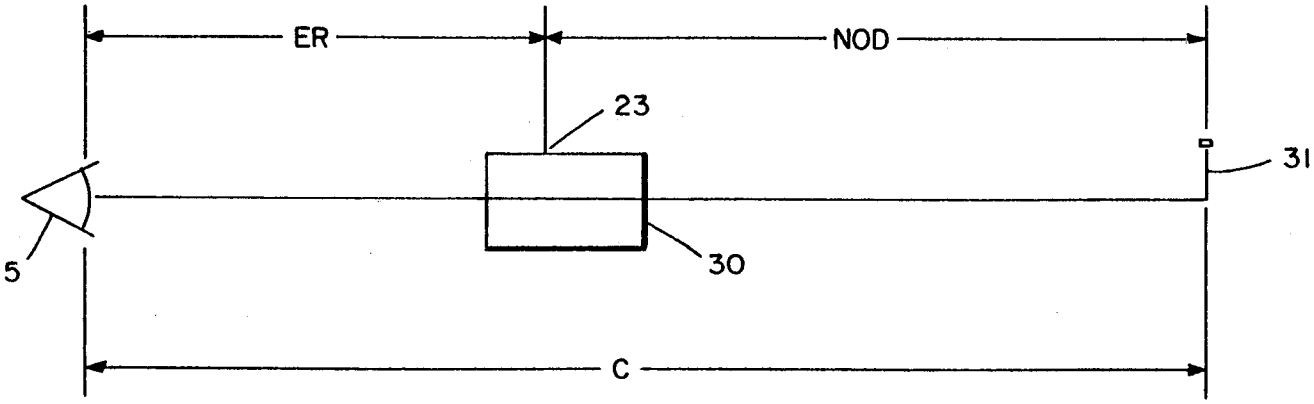
FIG. 10*b* is a diagram of formula ER=C−NOD by definition of different distance relationships.

Basically, the above distance interval relationships are set for any given scope power being employed on the weapon. The following formula illustrated in FIG. 10*b* and demonstrated in the following chart outline these relationships:

$$ER = C = NOD$$

WHERE:

ER = Eye relief or the distance from the eye cornea to The exit pupil of the scope NOD = The distance between scope exit pupil and the end post of the small arm

AND:

C = A constant, for any given power, which is equal to the sum of the ER and the NOD This formula may be used to produce a chart which relates the ER distance of the eye from the miniature telescope 34 to the NOD distance 35 at which the barrel end post 31 (FIGS. 9*a*, 10*a*) can be seen clearly. In this mode the target 32 (FIGS. 9*a*, 10*a*) at a much greater distance 21 can be viewed clearly simultaneously. It is commonly known that the eye relief for small arms 34 range from approximately 10 cm for shot guns and rifles to approximately 46 cm for hand guns and bows to allow for proper use and any recoil. (In actuality, if no reticle is used the miniature telescope may be placed from approximately eyelash length to arm's length of approximately 56 cm). Here, again by the previously sighted formula, eye lash length positioned telescopes above 2.5× would dictate use on only long barrel rifles and shot guns. It is well known that eye relief on any small arm is generally dictated by the design of the weapon. This design takes into account the need to protect the eye from injury resulting from weapon firing. Hence the standard minimal eye relief of 10 cm was used for the beginning power of 1.25× as seen in the following chart. Telescope focusing will be necessary with change in eye relief in order to maintain sharp imagery. It will be shown in the following chart that for a given relatively low powered miniature scope with an approximate exit pupil diameter of 0.4 cm the relationship between the two basic distances 34, 35 (FIGS. 9*a*, 10*a*) can be determined given one or the other.

| SCOPE POWER | ER | NOD | C |
|---|---|---|---|
| 1.25 | 10 cm | 46 cm | 56 cm |
| 1.50 | 15 cm | 46 cm | 61 cm |
| 1.75 | 20 cm | 46 cm | 66 cm |
| 2.0 | 25 cm | 46 cm | 71 cm |
| 2.25 | 30 cm | 46 cm | 76 cm |
| 2.5 | 35 cm | 46 cm | 81 cm |
| 2.75 | 40 cm | 46 cm | 86 cm |
| 3.0 | 46 cm | 46 cm | 92 cm |
| 3.25 | 50 cm | 46 cm | 96 cm |

Here, for simplicity, NOD is held at 46 cm for each power, and the calculated eye relief is presented. As a result of the formula ER = C − NOD, the required eye relief can be calculated for any NOD at a given power scope. Eye relief limitations are obvious in that beyond a reasonable distance of approximately 56 cm the field of view through the miniature scope is not large enough to prove useful. And, this factor looms greater in significance as the scope power is increased.

Figure 11:
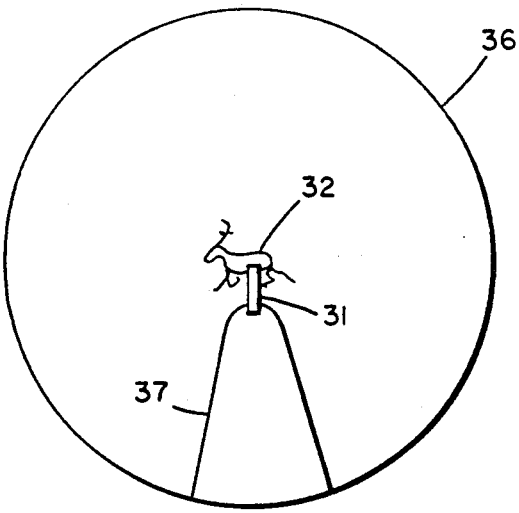
FIG. 11 illustrates an aiming situation as seen in a miniature Galilean or astronomical telescope with the characteristics of simultaneous viewing of target and sight denoted.

Using the above chart as a guide and designating the power of 1.25× for the miniature scope to be attached to a shot gun receiver sight aiming mechanism, the eye relief will be approximately 10 cm and the view which will be seen is in Figure 11. FIG. 11 illustrates the gun barrel 37 the end post 31 and the target 32 of scope view 36. Number 36 is equivalent to 23 (FIG. 6). This displays a clear view of the distant target, a deer 32, as well as a clear view of the end post 31, simultaneously.

When a reticle is attached to the scope a view such as FIG. 12 results. FIG. 12 is a replica of FIG. 11 with a crosshair reticle 28 superimposed on the magnified image and coordinated with the tip of end post 31. With the reticle the eye relief should be no less than the near point distance. For low power scopes the eye relief may thus be limited by near point rather then the above formula for ER.

The barrel end post 31 (FIGS. 9*a*, 10*a*, 11, 12) is used to calibrate/aim the weapon in standard fashion. Here the target 32 is placed in the center of the receiver sight picture or in this case the center of the magnified scope image 36 (FIG. 11). The end post 31 is then also placed in the image center on the target, and firing begins. The projectile range may be pre-set by adjusting the height of the end post. Another means of projectile range calibration/aiming would entail vertical scaling of the post with iridescent lines corresponding with the varying distance at which the target may be located.

The basic alignment adjustments for a receiver or iron sight 29 (FIG. 9*a*) is employed in its normal capacity. The miniature scope is most often attached to this device. Using the reticle and horizontal adjustment screws of a receiver sight for example (not shown) the scope and the barrel end post may be further aligned for greater accuracy.

The employment of a reticle 28 (FIG. 12) on the scope to be used in conjunction with the end post 31 of the barrel has never been attempted before. This is a primary feature of this invention. The coordinated use of these two structures contributes greatly to the alignment of the front and rear of the gun barrel with the intended target.

The type of targeting task to be performed will often dictate the power of the miniature scope to be used. Generally, the greater the target distance 21 (FIG. 9*a*) the higher the power needed. However, with this new method of calibrating/aiming a small arm, magnification is not of major significance. The primary impetus of this invention is that of achieving and maintaining a clear great depth of field to the extent that both weapon end post and distant target can be viewed sharply, simultaneously. This particular characteristic has not been realized, particularly for short barrel guns, before this invention. The device of U.S. Pat. No. 4,877,316 involving miniature scopes on small guns, displayed end posts and distant targets but not both clearly, simultaneously. These units included magnification with regular receiver sight aiming principles.

An example of simultaneous viewing telescopes would be a 1.25× unit with an exit pupil diameter of 0.8 cm and an eye relief of 46 cm. A second example would be a 2× telescope with an exit pupil diameter of 0.4 cm with an eye relief of 25 cm. These telescopes may be used with or without a reticle.

Although not unique to miniature type telescopes an undesirable characteristic involving reflected or glare type light can now be eliminated through the use of some new as well as traditional means. The techniques to be described for reduction of glare or glint type light reflecting from internal and external lens surfaces include anti-reflective coatings, objective and eyepiece lens hood tubes (with or without baffling structures) and transparent inclined deflector shields.

Figure 13:
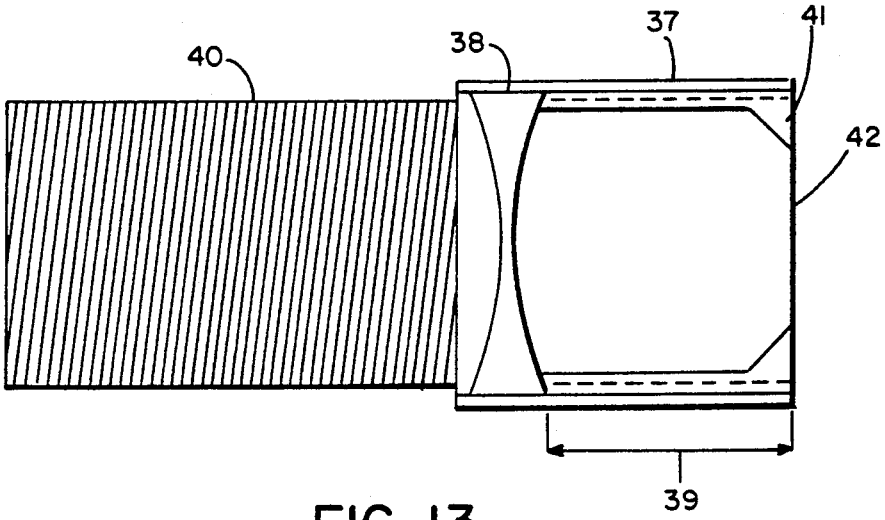
FIG. 13 displays a cut-away side view of the eyepiece portion of a Galilean scope barrel with emphasis placed on the hood extension behind the lens.

It is well known that light reflected from the objective or eyepiece lenses of standard larger astronomical telescopes can be controlled through the use of lens coatings as well as lens recessment. These anti-reflective coatings all but eliminate the glint of reflective light or "light spot". The "light spot" is distracting and tends to cause a hazing effect in the scope image. Recessing either lens down into the scope housing or adding a tubular hood to either end also effectively inhibits "light spot" reflection back into the eye. In a similar manner miniature scopes may have hoods 37, 44 (FIGS. 13, 15) attached over either the eyepiece 38 or objective lenses 45, respectively.

Figure 14:
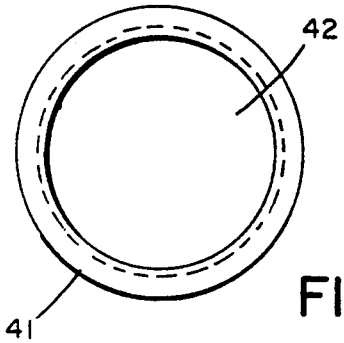
FIG. 14 is an end view of FIG. 13 illustrating the nature of a glare controlling structure.

In further explanation, with the Galilean scope eyepiece structure, particular attention must be paid to "light spot" control. Because the astronomical scopes use convergent eyepiece lenses 7 (FIG. 2) the mirror like surfaces act in a similar manner to that of a field expander mirror. Here the reflected light is dispersed from the rear eyepiece surface in a diffusing manner. That is the "light spot" radiates outward in a cone-like shape. The result is that relatively little of this reflected light enters the eye. With the additional lens recessment feature on these larger scopes the eye sees a diminished light glint of low nuisance value. However with the Galilean eyepiece lens of a divergent structural design, the reflected "light spot" is ultimately amplified. Hence, the hooded structure 37 (FIG. 13) which contains the eyepiece lens 38 of scope barrel 40 shades the lens from light striking its rear surface from the eye side. The distance or length 39 will vary both as a result of field of view required and of eye relief. As eye relief increases the greater the instance of "light spot" amplification and reflection. Normally the aimer's head would block light that would strike the eyepiece element's rear surface, thus preventing reflection. As the eye relief increases, however, beyond 10 cm particularly with Galilean systems, shading the eyepiece becomes more necessary. As the eye relief increases the distance 39 may require a length approaching 1 cm. An example of length 39 for a 1.25× telescope at an eye relief of 46 cm would be approximately of the environment, it may be necessary to fashion the rear end of hood 37 such that 41 and 42 (FIGS. 13, 14) characteristically resembles an internal glare reduction structure or baffle. These structures have been previously disclosed in U.S. application Ser. No. 07/343,030. In that application the structures reduced glare between the lenses of a miniature telescope. In the present mode (FIGS. 13, 14), however, this baffle application is added to the system externally from the lenses. This structure 41, 42 can be used in conjunction with both Galilean and astronomical units.

As a result of the overall dimensions of this invention with miniature scopes, 2.5 cm O.D. (outer diameter) by 10 cm in length maximally, the internal diameter of the glare reduction structure 42 (FIG. 14) can vary from 0.1 cm to 2 cm.

Figure 15:
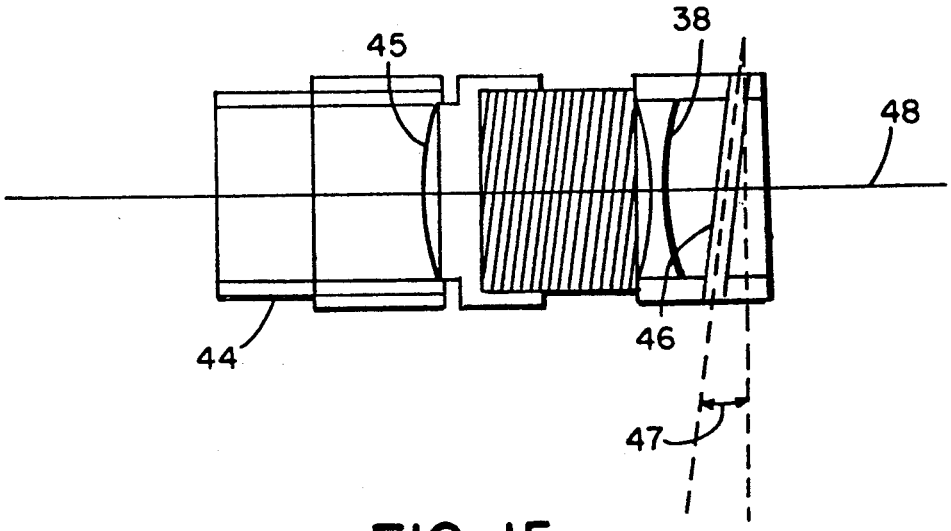
FIG. 15 is a cut-away side view of a miniature Galilean scope with emphasis placed on two principle structures consisting of a hood around the objective lens and an inclined glare shield behind the eyepiece lens.
Figure 16:
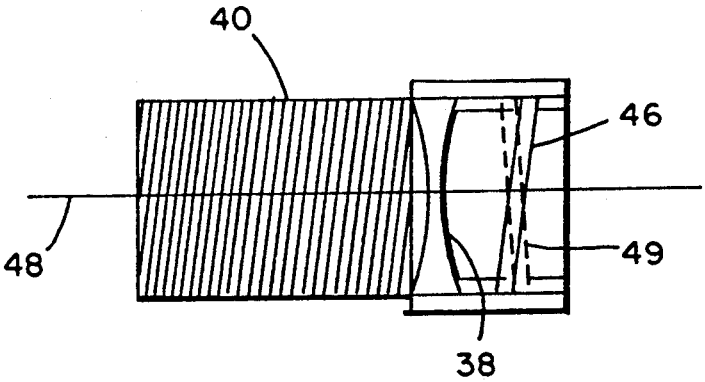
FIG. 16 is a cut-away side view of the eyepiece lens barrel of FIG. 15 illustrating alternate orientations for the eyepiece glare shield.

An alternative structure 46 (FIGS. 15, 16) to be used in the controlling of glare or "light spot" emanating from the eyepiece lens is illustrated. Again, when great eye relief is warranted there is an increased need for "light spot" control particularly for Galilean eyepieces. An alternative structure such as a transparent inclined plastic or glass shield can be successfully employed to dampen reflective glint from the rear surface of divergent eyepiece lenses. Such a shield structure 46 is inclined at approximately 3 to 7 degrees 47 to a plane that is perpendicular to the central axis 48. This shield both absorbs and reflects light which would normally impact on the rearward surface of the eyepiece lens 38. The shield's inclined angle enables it to direct reflected light away from the eye in a nonamplified manner. Depending again on lighting circumstances, such as incoming direction, the shield may be rotated to a new or different inclined orientation (FIG. 16). Here the orientation has been changed from 46 to 49. The shield may also be coated with anti-glare chemicals just as with the objective and eyepiece elements. Reorienting shield 46 requires only a slight 180 degree turn of barrel 40. In this manner reflectable light striking the inclined shield from any peripheral direction is, or can be, reflected away from the central line of sight 48 (FIGS. 15, 16).

This invention addresses the need to overcome problems inherent in calibrating/aiming and tracking targets with small arms. Unobtrusively, without disruption this invention is integrated into the peep, iron or receiver sight aiming mechanism of the small arm or bow and thereby eliminates the here-to-fore tolerated inability to focus clearly on distant and near objects simultaneously. This invention now makes possible the simultaneous viewing of both the small arm barrel end post and the distant target clearly and sharply with or without the aid of a reticle. Reticles may also be used in conjunction with the image of the low powered scopes for better aiming accuracy. The image viewed in the scope is not unlike that of one seen in a photograph of a landscape.

We claim:

1. An aiming mechanism for sighting a distant target comprising:

a sight for locating the target within a field of view; and a Galilean telescope positioned between the sight and a user's eye, the telescope being of power less than 3× and being positioned for eye relief greater than 10 cm such that both the distant target and the sight are simultaneously within the user's depth of field through the telescope.

2. An aiming mechanism as claimed in claim 1 wherein the exit pupil diameter is less than 0.6 cm.

3. An aiming mechanism as claimed in claim 1 wherein the sight is positioned at a distance no greater than 66 cm from the user's eye.

4. An aiming mechanism as claimed in claim 1 further comprising a reticle positioned to be viewed within the field of view of the telescope simultaneously with the sight as it is viewed through the telescope.

5. An aiming mechanism as claimed in claim 4 wherein the reticle is positioned beyond the objective lens of the telescope.

6. An aiming mechanism as claimed in claim 5 wherein the reticle comprises a fine line which is blurred to a wider line as viewed by the user.

7. An aiming mechanism as claimed in claim 4 wherein the reticle is positioned at about the eye piece of the telescope.

8. An aiming mechanism as claimed in claim 7 wherein the eye piece is positioned at about 25 cm. from the user's eye.

9. An aiming mechanism for sighting a target comprising:

a Galilean telescope;

a sight for locating the target within a field of view of the telescope;

a reticle positioned to be viewed within the field of view of the telescope simultaneously with the target and the sight as they are viewed through the telescope.

10. An aiming mechanism as claimed in claim 9 wherein the reticle is positioned beyond the objective lens of the telescope.

11. An aiming mechanism as claimed in claim 10 wherein the reticle comprises a fine line which is blurred to a wider line as viewed by the user.

12. An aiming mechanism as claimed in claim 9 wherein the reticle is positioned at about the eye piece of the telescope.

13. An aiming mechanism as claimed in claim 12 wherein the eye piece is positioned at least 25 cm from the eye.

14. An aiming mechanism for sighting a target comprising:

a Galilean telescope for viewing a target within a field of view of the telescope; and a sight positioned between the telescope and target to be viewed within the field of view of the telescope simultaneously with a target viewed through the telescope.

15. An aiming mechanism as claimed in claim 14 wherein a reticle is positioned beyond the objective lens of the telescope.

16. An aiming mechanism as claimed in claim 15 a fine line reticle which is blurred to a wider line as viewed by the user.

17. An aiming mechanism as claimed in claim 14 wherein a reticle is positioned at about the eye piece of the telescope.

18. An aiming mechanism as claimed in claim 17 wherein the eye piece is positioned at about 25 cm. from the eye.

19. An aiming mechanism for sighting a target comprising:

a sight for locating the target within the field of view;

a Galilean telescope positioned between the sight and a user's eye, the Galilean telescope having an exit pupil of less than 6 mm and a power of less than 3×;

the sight being positioned within 66 cm of a user's eye; and a reticle positioned to be viewed within the field of view of the telescope simultaneously with the sight and the target as they are viewed through the telescope, the reticle being positioned at about the eye piece of the Galilean telescope about 25 cm. from the user's eye.

20. A method of sighting comprising:

providing a sight for locating a distant target within a field of view;

providing a Galilean telescope of power less than 3× between the sight and the use's eye; and positioning the telescope and sight, with telescope eye relief greater than 10 cm., such that both the sight and the distant target are viewed simultaneously through the telescope.

21. A method as claimed in claim 20 further comprising providing a reticle and viewing the reticle within the field of view simultaneously with the sight and the target.

22. A method of sighting a target comprising:

providing a sight for locating the target within a field of view;

providing a Galilean telescope positioned between the sight and the user's eye;

providing a reticle; and simultaneously viewing the target, the reticle and the sight within the field of view of the telescope.

23. A method of sighting a target comprising:

providing a Galilean telescope;

positioning a sight between the telescope and a target within the field of view of the telescope; and simultaneously viewing the sight and the target within the field of view of the telescope.

24. An aiming mechanism for sighting a target comprising:

a Galilean telescope for viewing a target within a field of view of the telescope; and a reticle positioned beyond the objective lens of the telescope to be viewed within the field of view of the telescope simultaneously with a target viewed through the telescope.

25. An aiming mechanism as claimed in claim 24 wherein the reticle comprises a fine line reticle which is blurred to a wider line as viewed by the user.

26. An aiming mechanism for sighting a target comprising:

a Galilean telescope for viewing a target within a field of view of the telescope; and a reticle positioned at about the eye piece of the telescope to be viewed within the field of view of the telescope simultaneously with the target viewed through the telescope, the eye piece being positioned at about 25 cm. from the eye.

* * * * *